US006163943A

United States Patent [19]

Johansson et al.

[11] Patent Number: 6,163,943

[45] Date of Patent: Dec. 26, 2000

[54] METHOD OF PRODUCING A NONWOVEN MATERIAL

[75] Inventors: Bernt Johansson, Molnlycke; Lars Fingal, Gothenburg, both of Sweden

[73] Assignee: SCA Hygiene Products AB, Gothenburg, Sweden

[21] Appl. No.: 09/328,454

[22] Filed: Jun. 9, 1999

[30] Foreign Application Priority Data

Jun. 9, 1999 [SE] Sweden ..... 9703886

[51] Int. Cl.[7] ..... D04H 3/02; D04H 1/46

[52] U.S. Cl. ..... 28/104; 162/115

[58] Field of Search ..... 28/104, 105, 103, 28/106, 107, 167; 162/100, 101, 202, 115, 201, 91, 146, 289, 300, 315, 317, 212; 442/370, 400, 401, 408

[56] References Cited

U.S. PATENT DOCUMENTS

| | | | |
|---|---|---|---|
| 3,444,821 | 2/1970 | Evans | 161/169 |
| 3,849,241 | 11/1974 | Butin et al. | 161/169 |
| 4,048,364 | 9/1977 | Harding et al. | 428/113 |
| 4,100,324 | 7/1978 | Anderson et al. | 428/288 |
| 4,442,161 | 4/1984 | Kirayoglu et al. | 28/104 |
| 4,443,297 | 4/1984 | Cheshire et al. | 162/101 |
| 4,537,819 | 8/1985 | Schortmann et al. | 28/104 |
| 4,591,513 | 5/1986 | Suzuki et al. | 28/104 |
| 4,623,576 | 11/1986 | Lloyd et al. | 428/171 |
| 5,106,457 | 4/1992 | Manning | 162/115 |
| 5,516,572 | 5/1996 | Roe | 428/131 |
| 5,958,186 | 9/1999 | Holm et al. | 162/115 |

FOREIGN PATENT DOCUMENTS

| | | |
|---|---|---|
| 841938 | 5/1970 | Canada . |
| 308 320 | 3/1989 | European Pat. Off. . |
| 418 493 | 3/1989 | European Pat. Off. . |
| 333 211 | 9/1989 | European Pat. Off. . |
| 333 228 | 9/1989 | European Pat. Off. . |
| 503 059 | 7/1994 | Sweden . |
| 1 329 409 | 9/1973 | United Kingdom . |
| 96/02701 | 2/1996 | WIPO . |

*Primary Examiner*—Amy B. Vanatta
*Attorney, Agent, or Firm*—Burns, Doane, Swecker & Mathis, L.L.P.

[57] ABSTRACT

Method of producing a nonwoven material by hydroentangling a fiber mixture containing continuous filaments, e g meltblown and/or spunbond fibers, and natural fibers and/or synthetic staple fibers. The method is characterized by foamforming a fibrous web (14) of natural fibers and/or synthetic staple fibers and hydroentangling together the foamed fiber dispersion with the continuous filaments (11) for forming a composite material where the continuous filaments are well integrated with the rest of the fibers.

9 Claims, 8 Drawing Sheets

METHOD OF PRODUCING A NONWOVEN MATERIAL

BACKGROUND OF THE INVENTION

The present invention refers to a method of producing a nonwoven material by hydroentangling a fiber mixture containing continuous filaments and natural fibers and/or synthetic staple fibers.

Hydroentangling or spunlacing is a technique introduced during the 1970'ies, see e g CA patent no. 841 938. The method involves forming a fiber web which is either drylaid or wetlaid, after which the fibers are entangled by means of very fine water jets under high pressure. Several rows of water jets are directed against the fiber web which is supported by a movable wire. The entangled fiber web is then dried. The fibers that are used in the material can be synthetic or regenerated staple fibers, e g polyester, polyamide, polypropylene, rayon or the like, pulp fibers or mixtures of pulp fibers and staple fibers. Spunlace materials can be produced in high quality to a reasonable cost and have a high absorption capacity. They can e g be used as wiping material for household or industrial use, as disposable materials in medical care and for hygiene purposes etc.

In WO 96/02701 there is disclosed hydroentangling of a foamformed fibrous web. The fibers included in the fibrous web can be pulp fibers and other natural fibers and synthetic fibers.

Through e g EP-B-0 333 211 and EP-B-0 333 228 it is known to hydroentangle a fiber mixture in which one of the fiber components is meltblown fibers. The base material, i e the fibrous material which is exerted to hydroentangling, either consists of at least two preformed fibrous layer where one layer is composed of meltblown fibers or of a "coform material" where an essentially homogeneous mixture of meltblown fibers and other fibers is airlaid on a wire and after that is exerted to hydroentangling.

Through EP-A-0 308 320 it is known to bring together a web of continuous filaments with a wetlaid fibrous material containing pulp fibers and staple fibers and hydroentangle together the separately formed fibrous webs to a laminate. In such a material the fibers of the different fibrous webs will not be integrated with each other since the fibers during the hydroentangling are bonded to each other and only have a very limited mobility.

OBJECT AND MOST IMPORTANT FEATURES OF THE INVENTION

The object of the present invention is to provide a method for producing a hydroentangled nonwoven material of a fibrous mixture of continuous filaments, e g in the form of meltblown and/or spunbond fibers and natural fibers and/or synthetic staple fibers, where there is given a high freedom in the choice of fibers and where the continuous filaments are well integrated with the rest of the fibers. This has according to the invention been obtained by foamforming a fibrous web of natural fibers and/or synthetic staple fibers and hydroentangling together the foamed fiber dispersion with the continuous filaments for forming a composite material where the continuous filaments are well integrated with the rest of the fibers.

Through the foamforming there is achieved an improved mixing of the natural and/or synthetic fibers with the synthetic filaments, said mixing effect is reinforced by the hydroentangling, so that a composite material is obtained in which all fiber types are essentially homogenously mixed with each other. This is among other things shown by the very high strength properties of the material and by a wide pore volume distribution.

DESCRIPTION OF THE DRAWINGS

The invention will below be closer described with reference to some embodiments shown in the accompanying drawings.

DESCRIPTION OF SOME EMBODIMENTS

Figure 1:
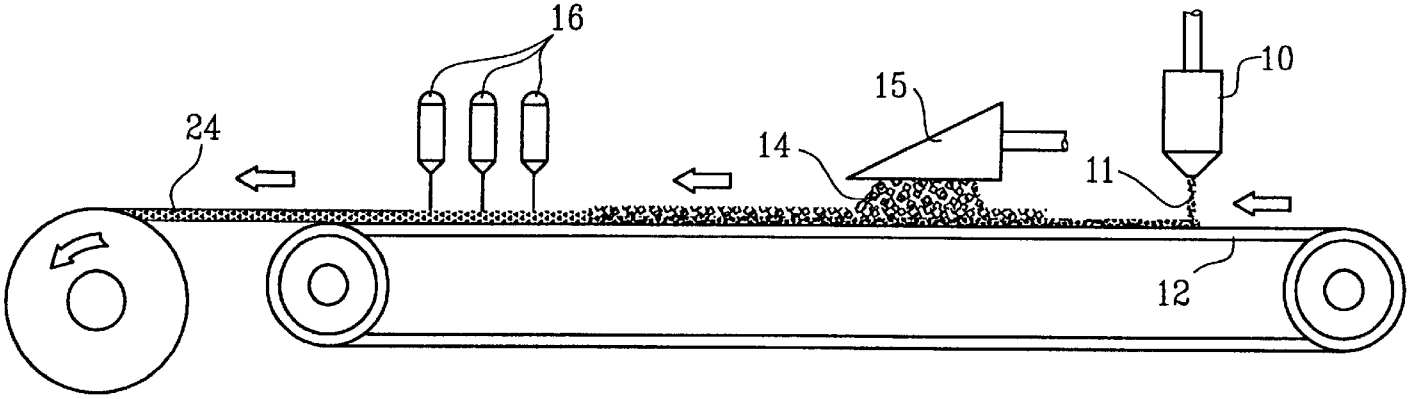
FIGS. 1–5 show schematically some different embodiments of devices for producing an hydroentangled nonwoven material according to the invention.

FIG. 1 shows schematically a device for producing a hydroentangled composite material according to the invention. A gas stream of meltblown fibers is formed according to conventional meltblown technique by means of a meltblown equipment 10, for example of the kind shown in the U.S. Pat. Nos. 3,849,241 or 4,048,364. The method shortly involves that a molten polymer is extruded through a nozzle in very fine streams and converging air streams are directed towards the polymer streams so that they are drawn out into continuous filaments with a very small diameter. The fibers can be microfibers or macrofibers depending on their dimension. Mcrofibers have a diameter of up to 20 $\mu$m, but usually are in the interval between 2 and 12 $\mu$m in diameter. Macrofibers have a diameter of over 20 $\mu$m, e g between 20 and 100 $\mu$m.

All thermoplastic polymers can in principle be used for producing meltblown fibers. Examples of useful polymers arer polyolefines, such as polyethylene and polypropylene, polyamides, polyesters and polylactides. Copolymers of these polymers may of course also be used, as well as natural polymers with thermoplastic properties.

Spunbond fibers are produced in a slighty different way by extruding a molten polymer, cool it and stretch it to an appropriate diameter. The fiber diameter is usually above 10 $\mu$m, e g between 10 and 100 $\mu$m.

The continuous filaments will in the following be described as meltblown fibers, but it is understood that also other types of continuous filaments, e g spunbond fibers, can be used.

According to the embodiment shown in FIG. 1 the meltblown fibers 11 are laid down directly on a wire 12 where they are allowed to form a relatively loose, open web structure in which the fibers are relatively free from each other. This is achieved either by making the distance between the meltblown nozzle and the wire relativley large, so that the filaments are allowed to cool down before they land on the wire 12, at which their stickiness is reduced. Alternatively cooling of the meltblown fibers before they are laid on the wire is achieved in some other way, e g by means of spraying with liquid. The basis weight of the formed meltblown layer should be between 2 and 100 g/m$^2$ and the bulk between 5 and 15 cm$^3$/g.

A foamformed fibrous web 14 from a headbox 15 is laid on top of the meltblown layer. Foamforming means that a fibrous web is formed from a dispersion of fibers in a foamed liquid containing water and a tenside. The foamforming technique is for example described in GB 1,329,409, U.S. Pat. No. 4,443,297 and in WO 96/02701. A foam-formed fibrous web has a very uniform fiber formation. For a more detailed description of the foamforming technique reference is made to the above mentioned documents. Through the intensive foaming effect there will already at this stage occur a mixing of the meltblown fibers with the foamed fiber dispersion. Air bubbles from the intensive turbulent foam that leaves the headbox 15 will penetrate down between and push apart the movable meltblown fibers, so that the somewhat coarser foam-formed fibers will be integrated with the meltblown fibers. Thus after this step there will mainly be an integrated fibrous web and no longer layers of different fibrous webs.

Fibers of many different kinds and in different mixing proportions can be used for making the foamformed fibrous web. Thus there can be used pulp fibers or mixtures of pulp fibers and synthetic fibers, e g polyester, polypropylene, rayon, lyocell etc. As an alternative to synthetic fibers natural fibers with a long fiber length can be used, e g above 12 mm, such as seed hair fibers, e g cotton, kapok and milkweed; leaf fibers e g sisal, abaca, pineapple, New Zealand hamp, or bast fibers, e g. flax, hemp, ramie, jute, kenaf. Varying fiber lengths can be used and by foamforming technique longer fibers can be used than what is possible with conventional wetlaying of fiber webs. Long fibers, ca. 18–30 mm, is an advantage in hydroentangling, since they increase the strength of the material in dry as well as in wet condition. A further advantage with foamforming is that is is possible to produce materials with a lower basis weight than is possible with wetlaying. As a substitute for pulp fibers other natural fibers with a short fiber length can be used, e g esparto grass, phalaris arundinacea and straw from crop seed.

The foam is sucked through the wire 12 and down through the web of meltblown fibers laid on the wire, by means of suction boxes (not shown) arranged under the wire. The integrated fibrous web of meltblown fibers and other fibers is hydroentangled while it is still supported by the wire 12 and herewith forms a composite material 24. Possibly the fibrous web can before hydroentangling be transferred to a special entangling wire, which possibly can be patterned in order to form a patterned nonwoven material. The entangling station 16 can include several rows of nozzles from which very fine water jets under very high pressure are directed against the fibrous web to provide an entangling of the fibers.

For a further description of the hydroentangling—or as it also is called the spunlace technique reference is made to e g CA patent 841,938.

The meltblown fibers will thus already before the hydroentangling be mixed with and integrated with the fibers in the foamformed fibrous web due to the foaming effect. In the subsequent hydroentangling the different fiber types will be entangled and a composite material is obtained in which all fiber types are substantially homogeneously mixed and integrated with each other. The fine mobile meltblown fibers are easily twisted around and entangled with the other fibers which gives a material with a very high strength. The energy supply needed for the hydroentangling is relatively low, i e the material is easy to entangle. The energy supply at the hydroentangling is appropriately in the interval 50–300 kWh/ton.

Figure 2:
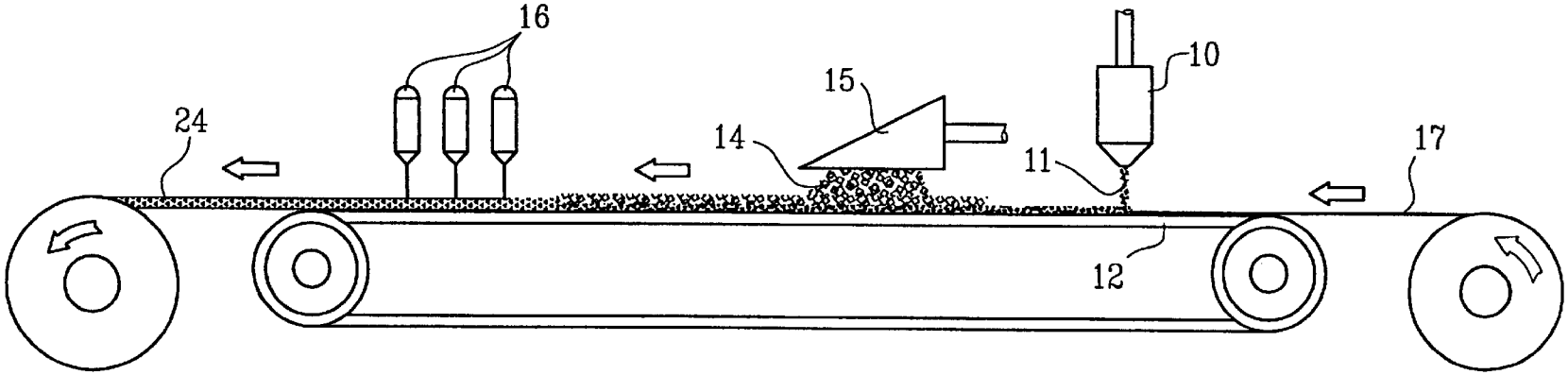

The embodiment shown in FIG. 2 differs from the former by the fact that a preformed tissue layer or spunlace material 17, i e a hydroentangled nonwoven material, is used, on which the meltblown fibers 11 are laid, after which the foamformed fibrous web 15 is laid on top of the meltblown fibers. The three fibrous layers are mixed due to the foaming effect and are hydroentangled in the entangling station 15 to form a composite material 24.

Figure 3:
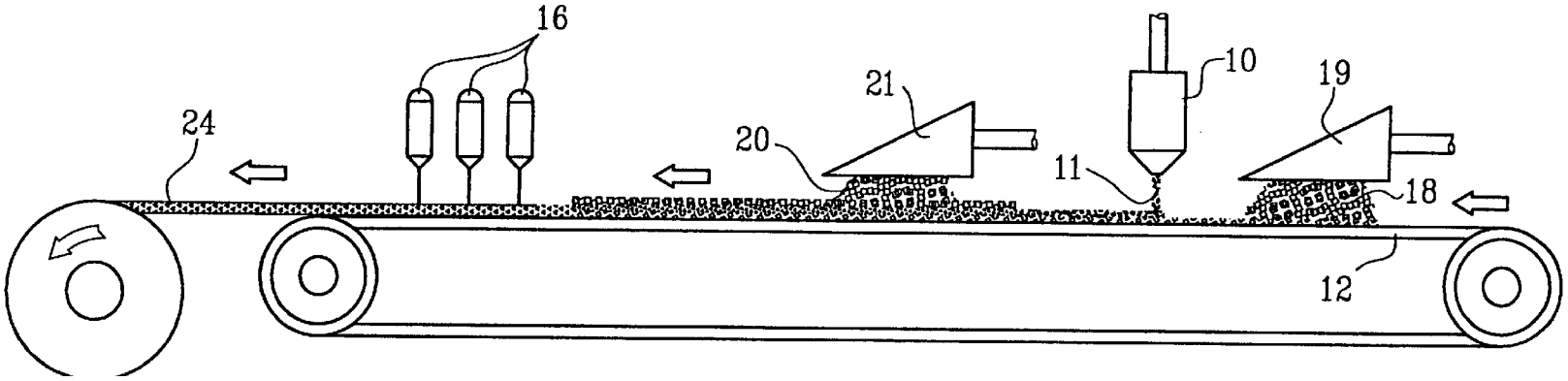

According to the embodiment shown in FIG. 3 a first foamformed fibrous web 18 is laid on the wire 12 from a first headbox 19, on top of the fibrous web the meltblown fibers 11 are laid and finally a second foamformed fibrous web 20 from a second headbox 21. The fibrous web 18, 11 and 20 formed on top of each other are mixed due to the foaming effect and are then hydroentangled while they are still supported by the wire 12. It is of course also possible only to have the first foamformed fibrous web 18 and the meltblown fibers 11 and hydroentangle together these two layers.

Figure 4:
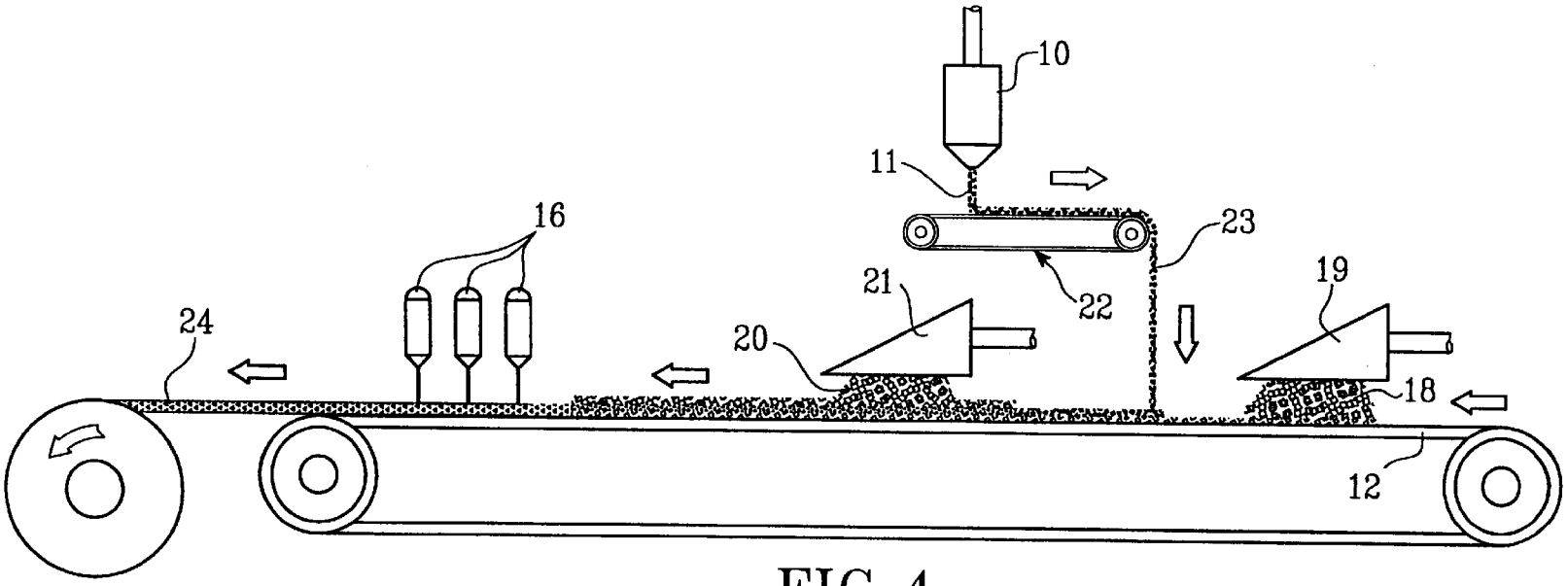

The embodiment according to FIG. 4 differs from the previous by the fact that the meltblown fibers 11 are laid on a separate wire 22 and the preformed meltblown web 23 is fed between the two foam forming stations 18 and 20. It is of course possible to use a correspondingly preformed meltblown web 23 also in the devices shown in FIGS. 1 and 2, where foamforming is made only from the upper side of the meltblown web 23.

Figure 5:
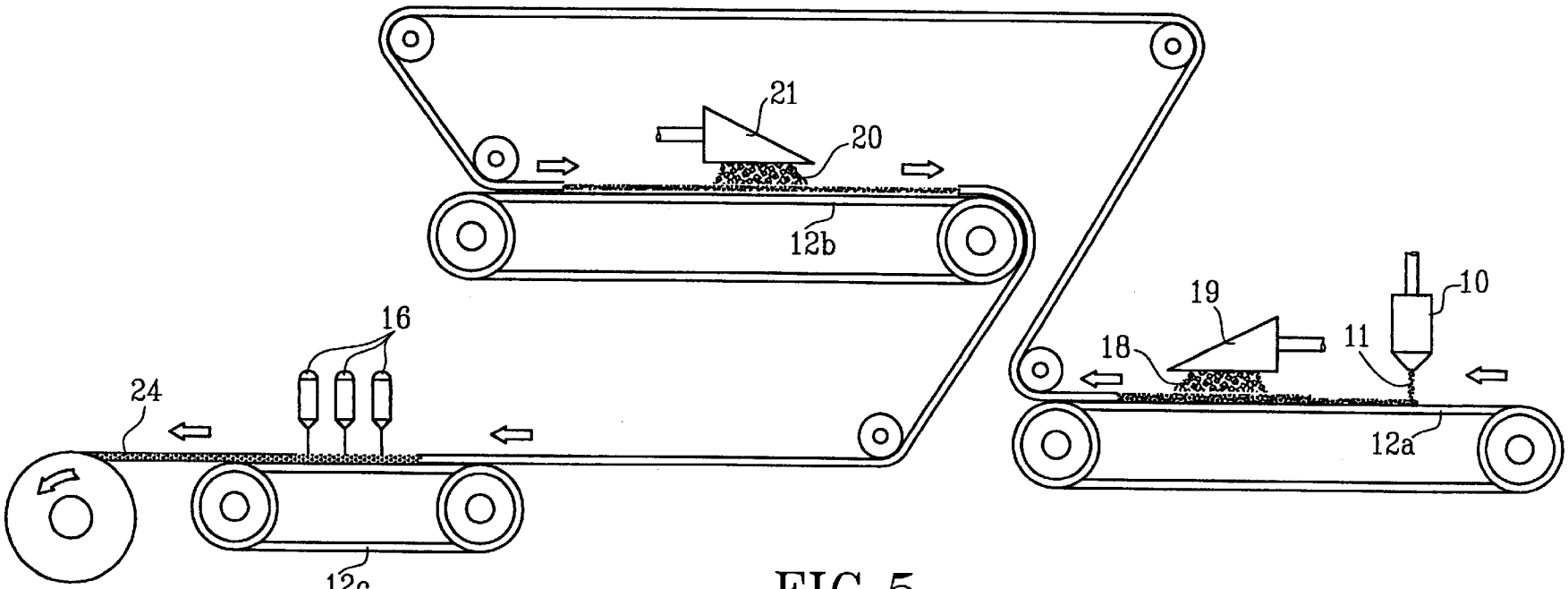
Figure 6:
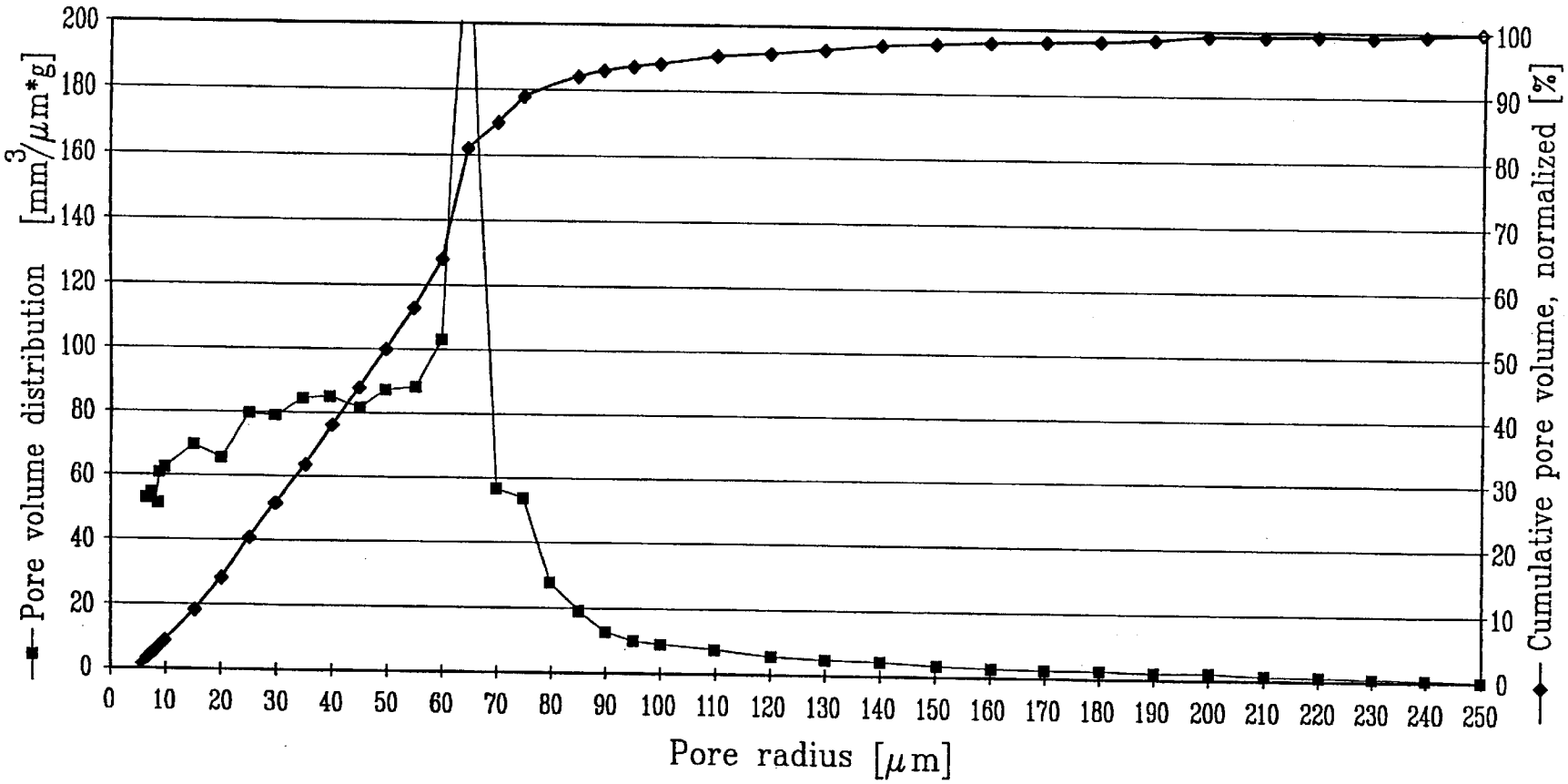
FIGS. 6 and 7 show the pore volume distribution in a reference material in the form of a foamformed spunlace material and of a spunlace matierial consisting only of meltblown fibers.

According to the embodiment shown in FIG. 5 a layer of meltblown fibers 11 are laid directly on a first wire 12*a*, after which a first foamformed fibrous web 18 is laid on top of the meltblown layer. The fibrous web is then transferred to a second wire 12*b* and turned over after which a second foamformed fibrous web 20 is laid on the "meltblown side" from the opposide side thereof. The fibrous web is transferred to an entangling wire 12*c* and is hydroentangled. For the sake of simplicity the fibrous web in FIG. 5 is not shown along the transporting portions between the forming—and entangling stations.

According to a further alternative embodiment (not shown) the meltblown fibers are fed directly into the foamed fiber dispersion, before or in connection to the formation thereof. The admixture of the meltblown fibers can for example be made in the headbox.

The hydroentangling is preferably made in a known manner from both sides of the fibrous material at which a more homogeneous equilateral material is obtained.

After the hydroentangling the material 24 is dried and wound up. The material is then converted in a known way to a suitable format and is packed.

EXAMPLE 1

A foamformed fiber dispersion containing a mixture of 50% pulp fibers of chemical kraft pulp and 50% polyester fibers (1.7 dtex, 19 mm), was laid on a web of meltblown fibers (polyester, 5–8 $\mu$m) with a basis weight of 42.8 g/m$^2$ and hydroentangled together therewith, at which a composite material with a basis weight of 85.9 g/m$^2$ was obtained. The energy supply at the hydroentangling was 78 kWh/ton. The material was hydroentangled from both sides. The tensile strength in dry and wet condition, the elongation and the absorption capacity of the material were measured and the results are shown in the table below. As reference materials a foamformed fibrous web (Ref. 1) and a meltblown web (Ref. 2) corresponding to those used for producing the composite material were hydroentanled. The measurement test results for these reference materials both separate and laid together to a double-layer material are presented in table 1 below.

TABLE 1

| | Composite | Ref. 1 | Ref. 2 | Ref. 1 + 2 drawn separately | Ref. 1 + 2 drawn together |
|---|---|---|---|---|---|
| Basis weight ($g/m^2$) | 85.9 | 43.6 | 42.8 | 86.4 | 86.4 |
| Thickness ($\mu$m) | 564 | 373 | 372 | 745 | 745 |
| Bulk ($cm^3/g$) | 6.6 | 8.6 | 8.7 | 8.6 | 8.6 |
| Tensile stiffness index | 102.5 | 22.2 | 8.8 | — | — |
| Tensile strength dry, MD (N/m) | 1155 | 540 | 282 | 822 | 644 |
| Tensile strength dry, CD (N/m) | 643 | 136 | 318 | 454 | 438 |
| Tensile index, dry, (Nm/g) | 10 | 6.2 | 7 | 7.1 | 6.1 |
| Elongation MD, % | 40 | 26 | 75 | — | — |
| Elongation CD, % | 68 | 116 | 103 | — | — |
| $\sqrt{MD \cdot CD}$ | 52 | 55 | 88 | | |
| Work to rupture MD ($J/m^2$) | 375 | 163 | 175 | — | — |
| Work to rupture CD ($J/m^2$) | 341 | 99 | 256 | — | — |
| Rupture index (J/g) | 4.2 | 2.9 | 4.9 | — | — |
| Tensile strength wet, MD, (N/m) | 878 | 372 | 299 | 671 | — |
| Tensile strength wet, CD, (N/m) | 538 | 45 | 285 | 330 | — |
| Tensile index wet (Nm/g) | 8 | 3 | 6.8 | 5.4 | — |
| Tensile strength tenside, MD, (N/m) | 605 | 116 | 281 | 397 | — |
| Tensile strength tenside, CD, (N/m) | 503 | 22 | 326 | 348 | — |
| Tensile index tenside (Nm/g) | 6.4 | 1.2 | 7.1 | 4.3 | — |
| Energy supply (kWh/ton) | 78 | 61 | 77 | — | — |
| Total absorption (g/g) | 4.5 | 6.1 | 0.2 | — | — |

As is seen from the above measurement results the tensile strength in dry as well as in wet condition and in tenside solution was considerably higher for the composite material than for the combined reference materials. This indicates that there is a good mixture between the meltblown fibers and the other fibers, which results in an increase of the material strength.

Figure 9:
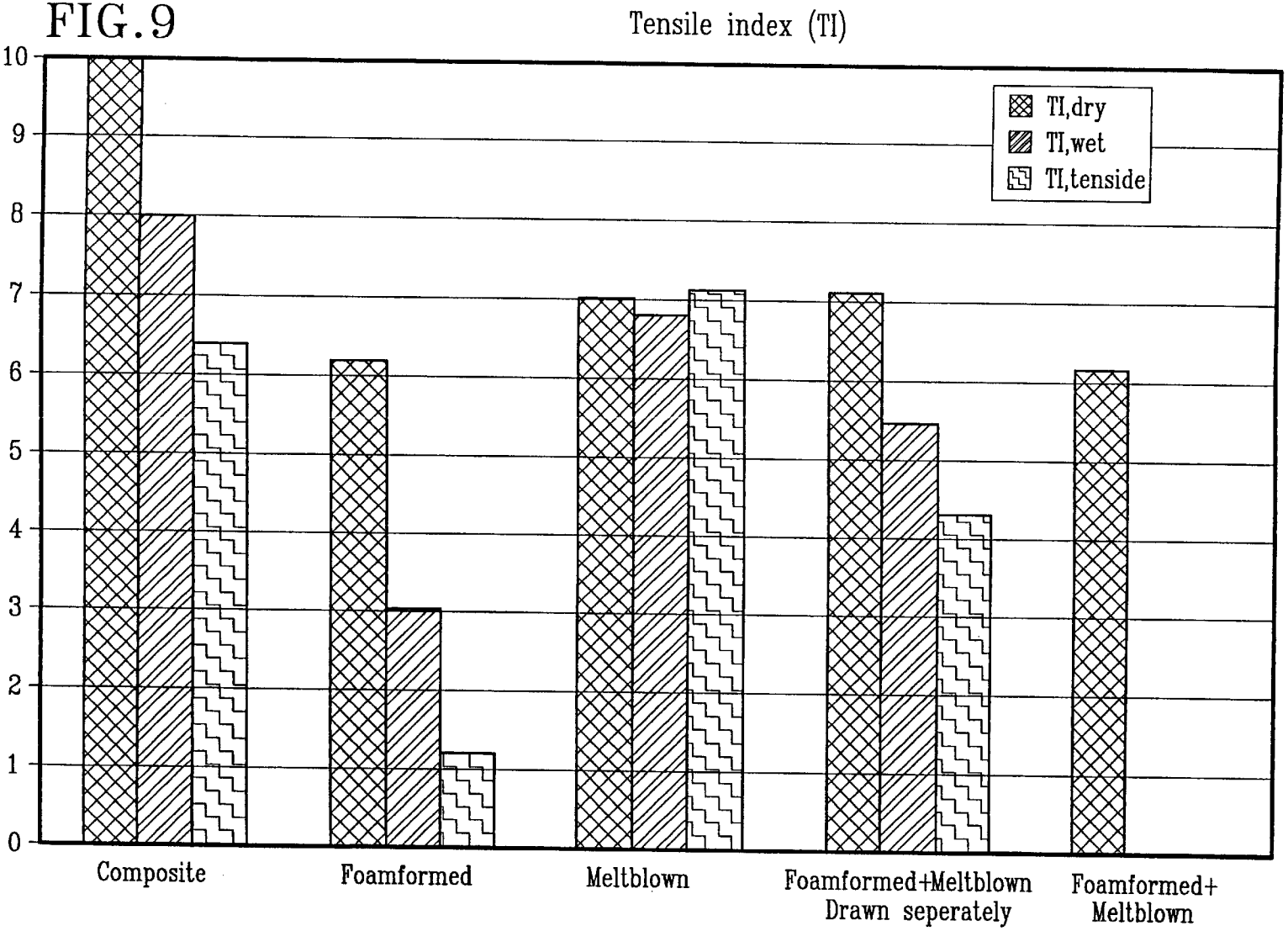
FIG. 9 shows in the form of a staple diagram the tensile strength in dry and wet condition and in a tenside solution for the composite material and for the two base materials included therein.

In FIG. 9 there is shown in the form of staple diagram the tensile index in dry and wet condition and in tenside solution for the different materials.

The total absorption of the composite material is almost as good for the reference material 1, i e a corresponding spunlace material without admixture of meltblown fibers. On the other hand the absorption was considerably higher than for the reference material 2, i e a pure meltblown material.

Figure 7:
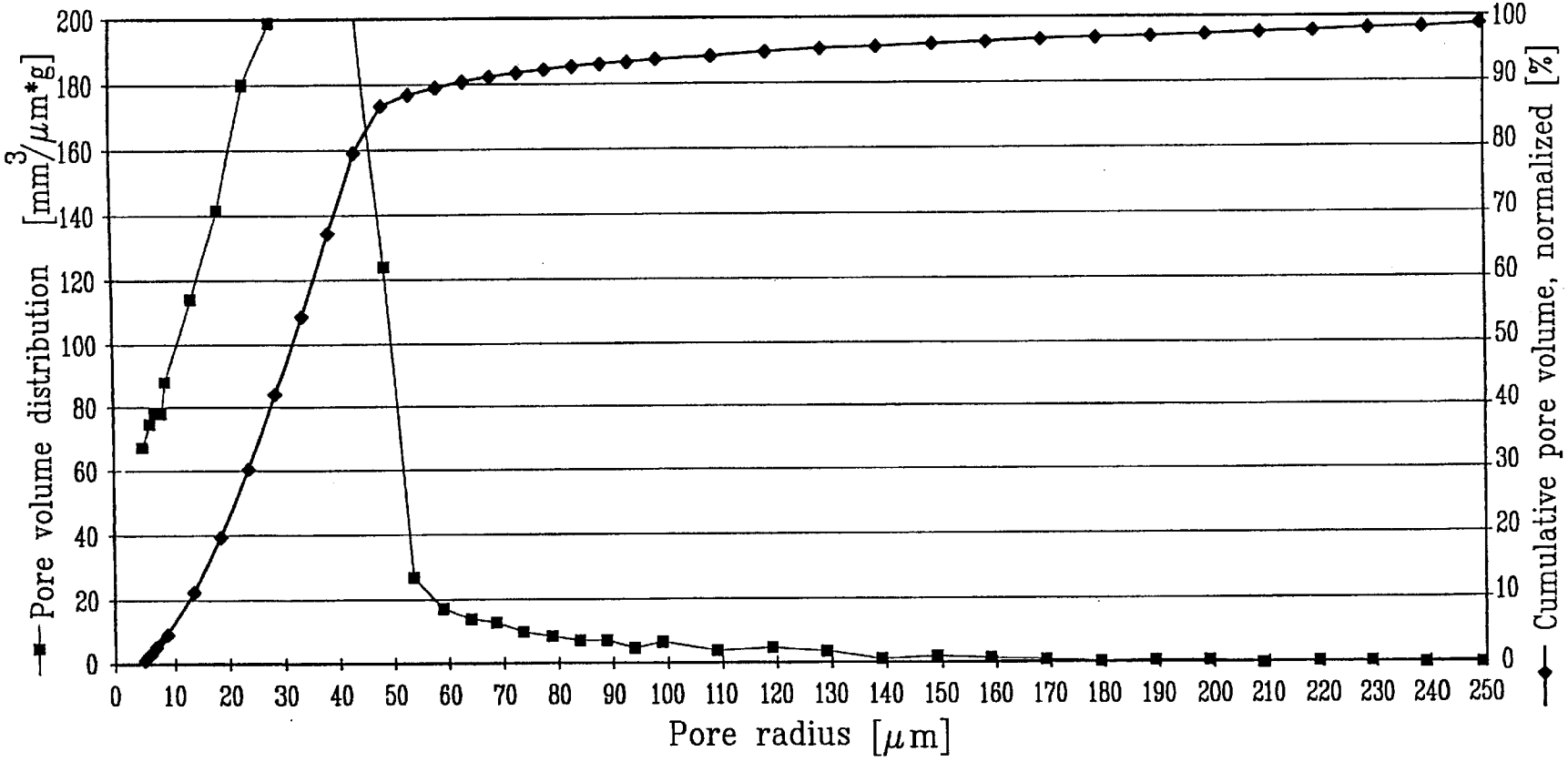
Figure 8:
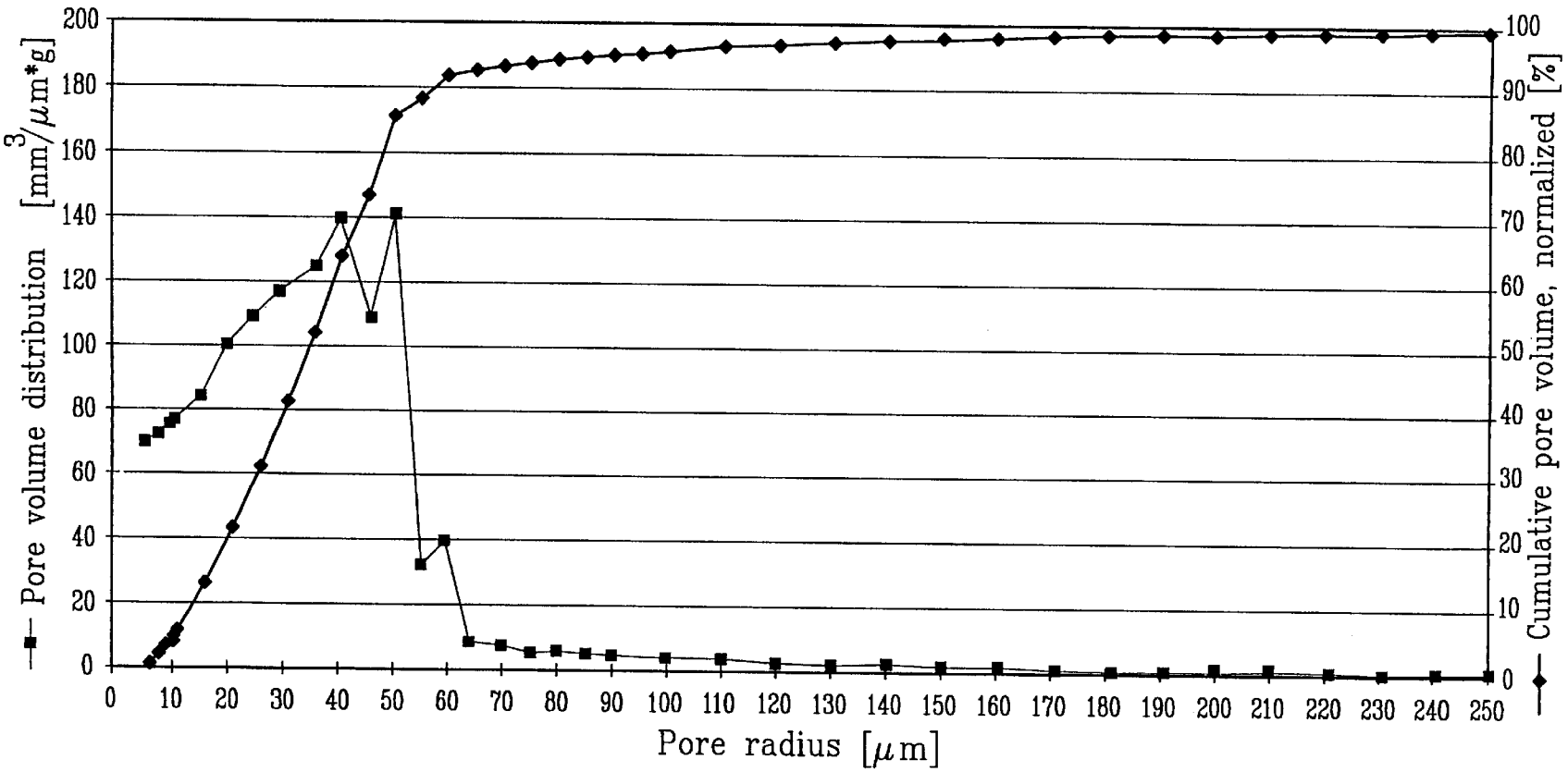
FIG. 8 shows the pore volume distribution in a composite material according to the invention.

In FIG. 7 there is shown the pore volume distribution of the foamformed reference material, Ref. 1, in $mm^3/\mu m.g$, and the normalized cumulative pore volume in %. It can be seen that the main part of the pores in the material are in the interval 60–70 $\mu$m. In FIG. 7 there is shown the corresponding pore volume distribution for the meltblown material, Ref. 2. The main part of the pores in this material are below 50 $\mu$m. From FIG. 8, which shows the pore volume distribution of the composite material according to above, it can be seen that the pore volume distribution for this material is considerably broader than for the two reference materials. This indicates that there is an effective mixture of fibers in the composite material. A broad pore volume distribution in a fibrous structure improves the absorption—and liquid distribution properties of the material and is thus advantageous.

Figure 10:
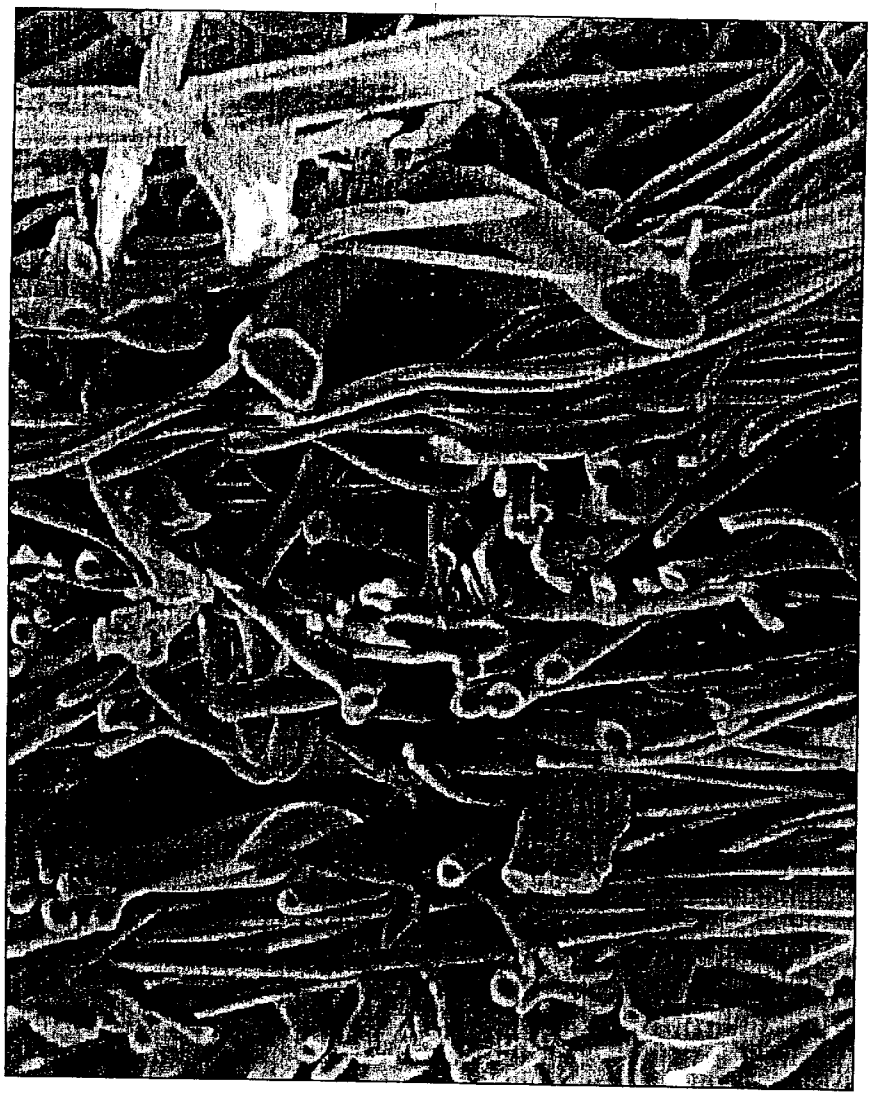
FIG. 10 is an electron microscope picture of a nonwoven material produced according to the invention.

It can also be seen from the electron microscope picture according to FIG. 10, which shows the composite material produced according to the above described example, that the fibers are well integrated and mixed with each other.

EXAMPLE 2

A number of hydroentangled materials with different fiber compositions were produced and tested with respect to tensile strength in wet and in dry condition, work to rupture and elongation.

Material 1: A foamformed fiber dispersion containing 100% pulp fibers of chemical kraft pulp, basis weight 20 $g/m^2$, was laid on both sides of a very slightly thermobonded, slightly compressed layer of spunbond fibers of polypropylene (PP) 1.21 dtex, basis weight 40 $g/m^2$, and was hydroentangled together therewith. The tensile strength of the PP-fibers was 20 cN/tex, the E-modulus was 201 cN/tex and the elongation was 160%. The material was hydroentangled from both sides. The energy supply at the hydroentangling was 57 kWh/ton.

Material 2: A layer of tissue paper of chemical pulp fibers was laid on both sides of a spunbond material, the same as in material A above. The material was hydroentangled from both sides. The energy supply at the hydroentangling was 55 kWh/ton.

Material 3: A foamformed fiber dispersion containing 100% pulp fibers of chemical kraft pulp, basis weight 20 $g/m^2$, was laid on both sides of a very slightly thermobonded, slightly compressed layer of spunbond fibers of polyester (PET) 1.45 dtex, basis weight 40 $g/m^2$, and was hydroentangled together therewith. The tensile strength of the PET-fibers was 22 cN/tex, the E-modulus was 235 cN/tex and the elongation 76%. The materialet was hydroentangled from both sides. The energy supply at the hydroentangling was 59 kWh/ton.

Material 4: A layer of tissue paper of pulp fibers (85% chemical pulp and 15% CTMP), with the basis weight 26 $g/m^2$ was laid on both sides of a spunbond material, the same as in material A above. The material was hydroentangled from both sides. The energy supply at the hydroentangling was 57 kWh/ton.

Material 5: A wetlaid fibrous web containing 50% polyester (PET) fibers (1.7 dtex, 19 mm) and 50% pulp fibers of chemical pulp was hydroentangled with an energy supply of 71 kWh/ton. The basis weight of the material was 87 $g/m^2$. The tensile strength of the PET-fibers was 55 cN/tex, the E-modulus was 284 cN/tex and the elongation was 34%.

Material 6: The same as for material 5 above but hydroentangled with a considerably higher energy supply, 301 kWh/ton. The basis weight of the material was 82.6 $g/m^2$.

Materials 1 and 3 are composite materials according to the present invention while materials 2 and 4 are laminate materials outside the invention and shall be seen as reference materials. Materials 5 and 6 are conventional hydroentangled materials and should also be seen as references. The energy supply at the hydroentangling of material 5 was of the same order of magnitude as was used for the hydroentangling of materials 1–4, while the energy supply at the hydroentangling of material 6 was considerably higher.

The results of the measurements are shown in table 2 below.

TABLE 2

| | Material 1 | Material 2 | Material 3 | Material 4 | Material 5 | Material 6 |
|---|---|---|---|---|---|---|
| Bases weight ($g/m^2$) | 86.7 | 93.3 | 83.6 | 90.7 | 87 | 82.6 |
| Thickness 2kPa ($\mu m$) | 520 | 498 | 415 | 470 | 550 | 463 |
| Bulk 2kPa ($cm^3/g$) | 6.0 | 5.3 | 5.0 | 5.2 | 6.3 | 5.6 |
| Tensile stiffness MD (N/m) | 18310 | 18290 | 20740 | 20690 | 10340 | 12590 |
| Tensile stiffness CD (N/m) | 3250 | 3531 | 6546 | 4688 | 1756 | 1709 |
| Tensile stiffness index (Nm/g) | 89 | 86 | 139 | 109 | 49 | 56.2 |
| Tensile strength dry MD, (N/m) | 4024 | 3746 | 4192 | 3893 | 2885 | 4674 |
| Tensile strength dry CD, (N/m) | 1785 | 1460 | 2255 | 1619 | 998 | 1476 |
| Tensile index dry (Nm/g) | 31 | 25 | 37 | 28 | 19.5 | 31.8 |
| Elongation MD (%) | 73 | 84 | 80 | 83 | 32 | 34.4 |
| Elongation CD (%) | 129 | 123 | 100 | 98 | 90 | 87.6 |
| Elongation √MDCD (%) | 97 | 102 | 89 | 90 | 54 | 55 |
| Work to rupture MD ($J/m^2$) | 2152 | 2618 | 2318 | 2370 | 600 | 906 |
| Work to rupture CD ($J/m^2$) | 1444 | 1216 | 1425 | 1084 | 484 | 695 |
| Work to rupture index (J/g) | 20.3 | 19.1 | 21.7 | 17.7 | 6.2 | 9.6 |
| Tensile strength MD, wet (N/m) | 4401 | 2603 | 4028 | 3574 | 2360 | 4275 |
| Tensile strength CD, wet (N/m) | 1849 | 1850 | 1940 | 1365 | 729 | 1363 |
| Tensile index wet (Nm/g) | 32.9 | 23.5 | 33.4 | 24.4 | 15.1 | 29.2 |
| Relative strength water (%) | 106 | 94 | 91 | 88 | 77 | 92 |
| Tensile strength MD tenside (N/m) | 3987 | 1489 | 3554 | 2879 | 874 | 3258 |
| Tensile strength CD tenside (N/m) | 1729 | 1083 | 1684 | 1214 | 234 | 985 |
| Tensile index tenside (Nm/g) | 30.3 | 13.6 | 29.3 | 20.6 | 5.2 | 21.7 |
| Relative strength tenside (%) | 98 | 54 | 80 | 74 | 27 | 68 |

The results show higher strength values for the composite materials according to the invention (materials 1 and 3) both compared to the corresponding laminate materials (materials 2 and 4) and compared to the wetlaid reference material (material 5) which had been entangled with an equivalent energy supply. Especially the tensile strength values as well wet, dry as in tenside are considerably higher for the composite materials according to the invention in comparison with the reference materials. The high strength values verifies that one has a composite material with very well integrated fibers.

For material 6 which had been entangled with a considerably higher energy supply (about 5 times higher) than for the composite materials the tensile strength in dry condition is on the same level as for the composite materials. The relative wet- and tenside strength as well as the work to rupture index are still markedly lower than for the composite materials.

As a further comparison two layers of the spunbond materials used in the above tests were hydroentangled. These material are denoted as materials 6 and 7.

Material 7: Two layers PP-spunbond, 1.21 dtex, each of the basis weight 40 $g/m^2$, were hydroentangled with an energy supply of 66 kWh/ton.

Material 8: Two layers PET-spunbond, 1.45 dtex, each of the basis weight 40 $g/m^2$, were hydroentangled with an energy supply of 65 kWh/ton.

The measurement results obtained with these materials are shown in table 3 below.

TABLE 3

| | Material 7 | Material 8 |
|---|---|---|
| Basis weight ($g/m^2$) | 78.2 | 78.4 |
| Thickness 2 kpa ($\mu m$) | 865 | 762 |
| Bulk 2kPa ($cm^3/g$) | 11.1 | 9.7 |
| Tensile stiffness MD (N/m) | 8314 | 9792 |
| Tensile stiffness CD (N/m) | 507 | 897 |
| Tensile stiffness index (Nm/g) | 26 | 38 |
| Tensile strength MD dry (N/m) | 642 | 798 |
| Tensile strength CD dry (N/m) | 183 | 558 |
| Tensile index dry (Nm/g) | 4 | 9 |
| Elongation MD (%) | 9 | 32 |
| Elongation CD (%) | 112 | 105 |
| Elongation √MDCD (%) | 32 | 58 |
| Work to rupture MD ($J/m^2$) | 313 | 604 |
| Work to rupture CD ($J/m^2$) | 253 | 508 |
| Work to rupture index (J/g) | 3.6 | 7.1 |
| Tensile strength MD wet (N/m) | 210 | 965 |
| Tensile strength CD wet (N/m) | 217 | 659 |
| Tensile index wet (Nm/g) | 2.7 | 10.2 |
| Relative strength wet (%) | 62 | 120 |
| Tensile strength MD tenside (N/m) | 840 | 713 |
| Tensile strength CD tenside (N/m) | 178 | 292 |
| Tensile index tenside (Nm/g) | 4.9 | 5.8 |
| Relative strength tenside (%) | 113 | 68 |

As is seen these material have considerably lower strength values in all aspects as compared to the composite materials according to the invention.

The composite material according to the invention has very high strength values at a very low energy supply at the entangling. The reason for this is the homogeneous fiber mixture that has been created, in which the synthetic fibers and the pulp fibers cooperate in the fibrous network so that unusually favourable synergistic effects are achieved. The high values for elongation and work to rupture verifies that there is a composite material with very well integrated fibers and that they cooperate so that the material can take up very large deformations without breaking.

The invention is of course not limited to the embodiments shown in the drawings and described above but can be modified within the scope of the claims.

What is claimed is:

1. A method of producing a nonwoven material by hydroentangling a fiber mixture of continuous filaments with natural fibers and/or synthetic staple fibers, the method comprising the steps of:

foamforming a fibrous web of the natural fibers and/or the synthetic staple fibers, forming a layer of continuous filaments, and hydroentangling together the foamed fiber dispersion with the continuous filaments to form a composite material where the continuous filaments are well integrated with the rest of the fibers.

2. The method as claimed in claim 1, wherein the foam forming occurs directly on the layer of continuous filaments and further comprising the step of draining the foam formed fibrous web through the filament layer.

3. The method as claimed in claim 1, wherein the layer of continuous filaments is laid directly on top of the fibrous web followed by draining of said fibrous web.

4. The method as claimed in claim 1, wherein the layer of continuous filaments is laid between two foamed fiber dispersions followed by draining said foamed fiber dispersions.

5. The method as claimed in claim 1, wherein the continuous filaments are laid on a preformed layer of tissue or nonwoven.

6. The method as claimed in claim 1, wherein the continuous filaments are fed directly into a foamed fiber suspension before or in connection with formation for forming said foamed fiber dispersion.

7. The method as claimed in claim 1, wherein pulp fibers are present in the foamed fiber dispersion.

8. The method as claimed in claim 1, wherein the continuous filaments are supplied in the form of a relatively loose, open weblike fibrous structure in which the fibers are substantially free from each other, so that they easily can be released from each other and be integrated with the fibers in the foamed fiber dispersion.

9. The method as claimed in claim 1, wherein the continuous filaments are meltblown fibers and/or spunbond fibers.

* * * * *